United States Patent [19]

Miller

[11] 4,204,832

[45] May 27, 1980

[54] GAS BURNER DEVICE

[75] Inventor: Robert F. Miller, Racine, Wis.

[73] Assignee: Modine Manufacturing Company, Racine, Wis.

[21] Appl. No.: 932,515

[22] Filed: Aug. 10, 1978

[51] Int. Cl.[2] ..... F23N 3/00

[52] U.S. Cl. ..... 431/20; 110/162

[58] Field of Search ..... 431/20, 2; 110/162; 236/15 BB, DIG. 9; 126/299 D

[56] References Cited

U.S. PATENT DOCUMENTS

| | | | |
|---|---|---|---|
| 2,671,503 | 3/1954 | Logan et al. | 431/20 |
| 3,146,821 | 9/1964 | Wuetig | 431/20 |

FOREIGN PATENT DOCUMENTS

| | | | |
|---|---|---|---|
| 2518750 | 11/1976 | Fed. Rep. of Germany | 126/299 D |

*Primary Examiner*—Carroll B. Dority, Jr.
*Assistant Examiner*—Lee E. Barrett
*Attorney, Agent, or Firm*—Wegner, Stellman, McCord, Wiles & Wood

[57] ABSTRACT

A gas burner device having a gas supply and a primary air supply and secondary air supply to the burner and a flue gas vent means leading from the burner for venting flue gases to a place of disposal. The device has a power driven fan in the flue gas vent for providing simultaneously a forced flow of flue gases away from the burner flame and of primary and secondary air to the flame, a temperature responsive variable speed control for controlling the power supply to the fan motor and thereby the speed of the fan and the rate of movement of the exhaust gas from the burner and flame and primary and secondary air to the flame in direct proportion to the temperature of the flue gases.

7 Claims, 1 Drawing Figure

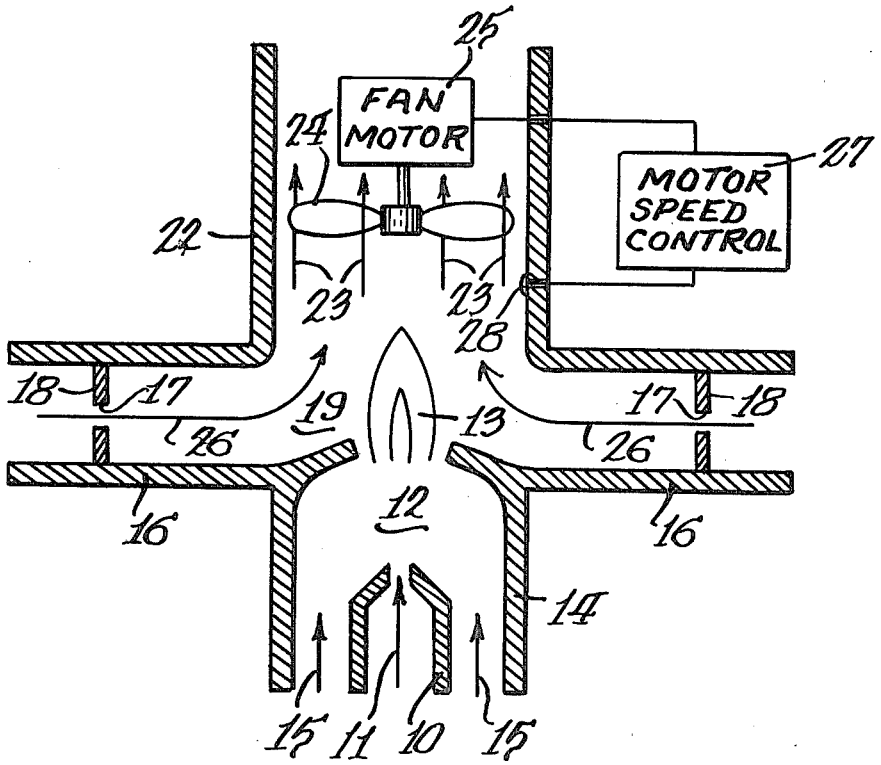
25
FAN MOTOR
24
27
MOTOR SPEED CONTROL
22
23
23
28
18
17
19
13
17
18
26
26
16
12
16
14
15
11
10
15

GAS BURNER DEVICE

BRIEF DESCRIPTION OF THE DRAWING

In the single FIGURE of the drawing there is illustrated semi-schematically a gas burner device embodying the invention.

DESCRIPTION OF THE PREFERRED EMBODIMENT

In this single FIGURE of the drawing there is provided a gas supply duct 10 for providing fuel gas 11 to a burner 12 to maintain a flame 13. Surrounding the gas supply duct 10 is a primary air supply duct 14 for providing primary air 15 to the flame 13.

Also leading to the flame 13 are a plurality, here shown as two, secondary air ducts 16. Located in each of these ducts 16 is a calibrated orifice, illustrated semi-schematically by the orifice 17 in each of two orifice plates 18.

Leading from a combustion zone 19 in which the flame 13 is located at the common area of convergence of the gas duct 10, primary air duct 14 and secondary air ducts 16 is a flue gas vent duct 22 for exhausting flue gases 23 to a place of disposal.

Positioned within the flue gas vent duct 22 is a fan or blower illustrated by the fan 23 which is operated by an electric motor 25. This fan 24 is located just above the combustion zone 19 and functions as a suction fan to draw the flue gases 23 away from the flame 13 in the zone 19 and to draw the secondary air 26 into the vicinity of the flame 13 as illustrated by the arrows 26 in the drawing.

The speed of the fan 24 and thus its draft moving capacity is governed by a motor speed control 27 of conventional design and manufacture that is controlled by the flue gas temperature adjacent to the entrance to the flue gas vent duct 22 by means of a temperature sensor 28 located in the vent duct 22 adjacent to the flame 13. The speed control 27 operated by the sensor 28 controls the fan speed in direct proportion to the temperature within the duct 22 adjacent to the flame 13. Thus as the temperature rises in the vent duct the fan speed 24 increases, the flow of flue gases 23 increases and the suction of secondary air 26 into the combustion zone 19 increases.

Thus increasing the speed of the fan 24 lowers the temperature of the flue gases 23 by increasing the volumetric flow of secondary air 26 into and through the combustion zone 19. This regulating of the volumetric flow of secondary air 26 by the temperature of the flue gases in the duct 22 results in a highly efficient operation of the gas burner device and also assures complete combustion of the gas 11 in the flame 13.

The operation of the gas burner device is as follows. Primary air 15 and gas 10 are mixed in the conventional manner in the burner 12 and directed into the combustion zone 19 to maintain the flame 13. At the same time, secondary air 26 is drawn into the combustion zone 19 in the vicinity of the flame 13 through the caliberated orifice 17 in the customary manner. Because of the relationship of the various ducts and the fan 23 the volumetric flow of this secondary air 26 is controlled by the speed of the fan 24 which in turn is controlled by the temperature sensor 28 that is in the flue gas vent duct 22 adjacent to the flame 13 and upstream from the fan 24. In other words, the sensor 28 is between the flame 13 and the fan 24.

As the temperature of the flue gases 23 in the vicinity of the sensor 28 rises the sensor operating through control 27 increases the speed of the fan motor 25 and thus of the fan 24. The resultant suction increase of the volume rate of flow of the secondary air 26 acts to lower the flue gas temperature which thereupon reduces the speed of rotation of the fan 24. An equilibrium is quickly reached between the rate of secondary air flow 26 and the temperature of the flue gases 23 so that the gas burner device of this invention quickly achieves an operation at an optimum secondary air flow of high efficiency and complete combustion of the fuel gas 11 in the flame 13.

Having described my invention as related to the embodiment shown in the accompanying drawing, it is my intention that the invention be not limited by any of the details of description, unless otherwise specified, but rather be construed broadly within its spirit and scope as set out in the appended claims.

I claim:

1. A gas burner device, comprising: a gas supply means; a gas burner receiving gas from said gas supply means; a primary air supply duct means for supplying primary air to said burner; a secondary air supply duct means for supplying secondary air to said burner, said primary air supply and secondary air supply maintaining combustion of said gas to produce a flame; a flue gas vent means leading from said burner and flame for venting flue gases to a place of disposal; a power driven fan means communicating with said flue gas vent means for providing simultaneously a forced flow of flue gases away from said flame and of said primary and secondary air to said flame; a temperature responsive variable speed control for controlling the power supplied to said motor and thereby the speed of said fan; and a flue gas temperature sensor means in said flue gas vent operatively connected to said motor speed control for controlling the speed of the fan and thereby simultaneously the rate of flow of the flue gases and the primary and secondary air by said fan in direct relation to the temperature of said flue gases.

2. The device of claim 1 wherein said fan is located downstream of both said primary and secondary air supply ducts to cause suction air flow through said ducts.

3. The device of claim 1 wherein said temperature sensor means is located in said flue gas vent means adjacent to said flame.

4. The device of claim 1 wherein said temperature sensor means is located in said flue gas vent means adjacent to said flame and upstream of said fan.

5. The device of claim 1 wherein said fan is located downstream of both said primary and secondary air supply ducts to cause suction air flow through said ducts and wherein said temperature sensor means is located in said flue gas vent means adjacent to said flame and upstream of said fan.

6. The device of claim 1 wherein there is provided a duct containing both the gas supply means and the primary air supply means to said burner and in which the primary air and gas are mixed prior to the introduction of said secondary air.

7. The device of claim 6 wherein said fan is located downstream of both said primary and secondary air supply ducts to cause suction air flow through said ducts and wherein said temperature sensor means is located in said flue gas vent means adjacent to said flame and upstream of said fan.

* * * * *